United States Patent [19]

Baggio et al.

[11] Patent Number: 4,694,592

[45] Date of Patent: Sep. 22, 1987

[54] CLOSURE DEVICE PARTICULARLY FOR REAR ENTRANCE SKI BOOTS

[75] Inventors: Giorgio Baggio, San Martino Di Lupari; Renzo Balbinot, Vittorio Veneto, both of Italy

[73] Assignee: Nordica S.p.A., Montebelluna, Italy

[21] Appl. No.: 815,858

[22] Filed: Jan. 3, 1986

[30] Foreign Application Priority Data

Jan. 11, 1985 [IT] Italy ..... 20468/84 [U]

[51] Int. Cl.[4] ..... A43B 5/04

[52] U.S. Cl. ..... 36/117; 36/50

[58] Field of Search ..... 36/117-121, 36/50; 24/68 SK, 69 SK, 70 SK, 71 SK

[56] References Cited

U.S. PATENT DOCUMENTS

| | | | |
|---|---|---|---|
| 4,408,403 | 10/1983 | Martin | 36/50 X |
| 4,539,763 | 9/1985 | Walkhoff | 36/120 |
| 4,571,855 | 2/1986 | Blanc | 36/50 |

FOREIGN PATENT DOCUMENTS

| | | | |
|---|---|---|---|
| 0053340 | 6/1982 | European Pat. Off. | 36/120 |
| 3342121 | 6/1984 | Fed. Rep. of Germany | 36/117 |
| 3247516 | 6/1984 | Fed. Rep. of Germany | 36/117 |
| 3442780 | 6/1985 | Fed. Rep. of Germany | 36/117 |
| 3406591 | 8/1985 | Fed. Rep. of Germany | 36/117 |
| 2450575 | 10/1980 | France | 36/50 |
| 2475372 | 8/1981 | France | 36/50 |

*Primary Examiner*—James Kee Chi

*Attorney, Agent, or Firm*—Guido Modiano; Albert Josif

[57] ABSTRACT

The closure device comprises a lever having a recessed area, being articulated on the rear portion of a ski boot rear quarter and oscillable about a substantially perpendicular axis with respect to the longitudinal extension of the rear quarter and the shell. To said lever there being slidably connected a block, releasably securable on preset points of said lever and being associated with at least one cable having a fixed point on the boot's front quarter, and at least partially accommodated in the recessed area.

6 Claims, 4 Drawing Figures

CLOSURE DEVICE PARTICULARLY FOR REAR ENTRANCE SKI BOOTS

BACKGROUND OF THE INVENTION

This invention relates to a closure device particularly for rear entrance ski boots.

As is known, to close or fasten on ski boots, and especially rear entrance ski boots, i.e. to tighten the boot front quarter and rear quarter together, levers have been used which are arranged transversely to the longitudinal direction of the quarters and comprise a body associated with either the interior or the exterior of the front quarter and on which a small cable or link is hooked which is attached to the lever.

The bodies currently employed are generally of a design which protrudes outwardly and may be caught or hit when skiing, to result in the lever being accidentally released.

Furthermore, rear entrance ski boots generally utilize two such closure levers, located at different elevations, which must be operated separately and progressively if a proper closure is to be attained.

It thus occurs, with the prior art approach, that the boot may be occasionally difficult and slow to close, and that the user is to lean down to operate the levers, thus assuming a position which is very inconvenient.

SUMMARY OF THE INVENTION

It is the aim of this invention to overcome such prior shortcomings by providing a closure device, specially designed for use with rear entrance ski boots, which allows the quarters to be closed together in a very quick manner and without having the elements which make up the boot closure means separated from one another.

Within the above aim, it is a particular object of the invention to provide a closure device which affords quick and effective operation with a single lever to close the quarters together.

Another object of the present invention is to provide a closure device which can be operated by the user without undue leaning, but using, for example, the tip of a ski pole or even the toe of the other ski boot.

A not least object of the present invention is to provide a closure device which is simplified in construction, to contribute toward a reduction of manufacturing costs.

Within the above aim, it is a particular object of the invention to provide a closure device particularly for rear entrance ski boots, according to the invention, characterized in that it comprises a lever articulated to the rear portion of a ski boot rear quarter and being oscillable about a substantially perpendicular axis to the longitudinal direction of said rear quarter and the shell, to said lever there being slidably connected a block, releasably securable on preset points of said lever and being associated with at least one cable having at least one fixed point on the front quarter of said boot.

BRIEF DESCRIPTION OF THE DRAWINGS

Further features and advantages will become apparent from the following detailed description of a closure device particularly for rear entrance ski boots, as shown by way of illustration and not of limitation in the accompanying drawing, where.

DESCRIPTION OF THE PREFERRED EMBODIMENTS

Figures 1, 2, 3, 4:
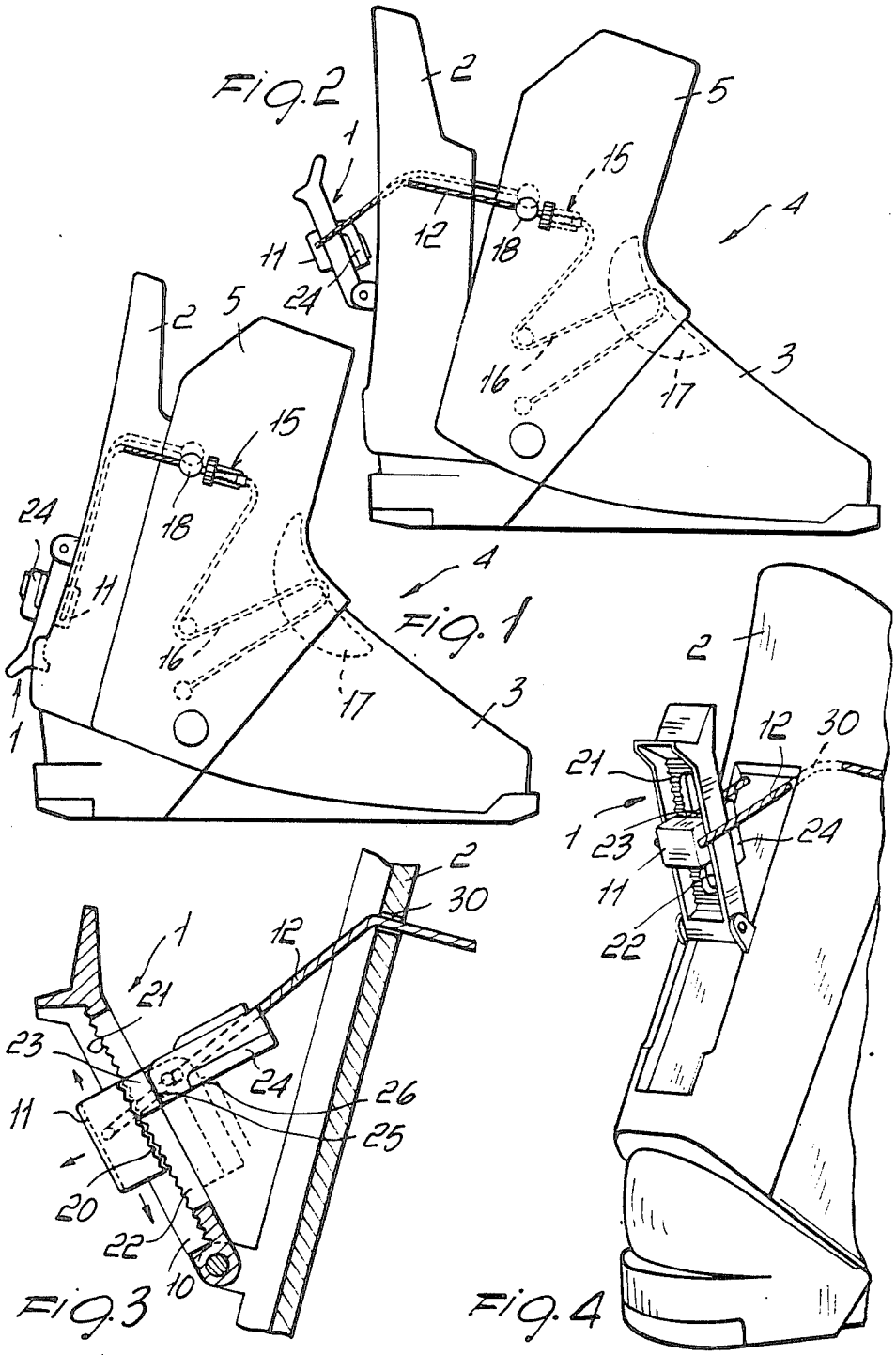
FIG. 1 shows diagramatically the closure device of this invention as applied to a boot in the closed position.
FIG. 2 shows the device of this invention as applied to a boot in the open position.
FIG. 3 is a partly sectional view of the device in in the open position.
FIG. 4 is a perspective view of the device as applied to a boot.

With reference to the drawing figures, a closure device particularly for rear entrance ski boots, according to the invention, comprises a lever, generally designated with the reference numeral 1, which is articulated to the rear portion of a ski boot rear quarter 2, the ski boot being generally indicated at 4.

The cited lever 1 is articulated to the rear quarter 2 for oscillation about a substantially perpendicular axis with respect to the longitudinal direction of the quarter and the longitudinal direction of the boot shell 3.

The cited lever 1 has on one face or side thereof a recessed area 10 wherein is accommodated a block 11 releasably securable at different points of the lever by locking means, to be explained hereinafter.

With the block 11 there engages a cable 12 which has at least one of its ends connected to a fixed point on the front quarter 5 and the other end either connected to a fixed point directly on the quarter 5 or possibly associated, with the interposition of a length adjuster assembly 15, to an extension cable 16 which is routed inside the shell 3 and extends crosswise of a foot instep presser 17, thereby in addition to attaining the boot closure, the foot instep can be locked securely as explained hereinafter.

Where the extension cable 16 is provided to close the foot instep presser onto the front quarter 5 there is provided a locking detent 18 which acts as a retainer for the cable 15 length variator element, thereby on operating the lever, the foot instep is preliminarly locked and successively the quarters are closed together during the lever operation.

The length of the cable 12 can be varied through an adjustment of the disclosed or the like type, to be obtained with conventional means on both fastening points to the front quarter 5, thus meeting the requirements of those having a large calf and a thin calf.

The block 11, as described above, is partly accommodated within the recess 10 and is positionable at various points of the lever itself, so as to vary the clamping action applicable through the cable 12.

In order to obtain closure of the ski boot, the block 11 is provided on the face or side confronting the bottom of the recess 10, with a serration 20 coupleable with a mating serration 21 defined on the bottom of the recess 10 while in this closing angular position the opposite side faces away from the quarter 2. On the bottom of the recess 10 there is provided a longitudinal slot 22 wherein a tang 23 is slidably accommodated which extends from the block 11 and is articulated, at its free end, to a camming lever 24 which has a first section 25 at a reduced distance from the articulation point, thereby the distance from the surface of the first section 25 to the serration 20 is greater than the thickness of the lever 1, at the bottom of the recess 10, thereby the serration 20 can be disengaged from the mating serration 21.

The camming lever 24 has a second surface 26 further from the articulation point of the lever 24 to the tang 23, such that, on rotating the lever to bring the surface 26 to contact the lever 1, one attains the locking coupling of the serration 20 with the mating serration 21, which results in the block 11 being locked in place.

Thus the block 11 can be positioned quickly and easily at a selected point on the lever 1 and then its position made stable by turning the camming lever 24 to be close against the surface 1, with consequent coupling of the serrations.

It should be added to the foregoing that the cable 12 is preferably passed through a guide channel 30 provided in the top portion of the rear quarter 2, so that closure is accomplished by pushing the lever 1 down; this provides for an easier closure in that, in a known manner closure is easier to execute when effected in a downward direction by means of an operation which may be performed by means of the other boot.

With the lever in its closed position shown in FIG. 1, on the exposed face of the lever i.e. the side facing away from the rear quarter there is provided a control means for locking in position the block 11, the control means being in the form of a camming lever 24, so that the user, when he/she wishes to open, he/she can do so without having to bend down, by acting with the tip of the ski pole on the camming lever and move it into the unlocked position, thus allowing the cable to relax and effecting subsequent opening, by swinging the lever 1 in its opening angular position shown in FIGS. 2, 3, 4, in which its side bearing the camming lever faces towards the quarter 2 whilst the side bearing the block 11 faces away from the quarter 2.

As previously described, the closure device may be set, additionally to clamping the quarters together, also to actuate the foot instep presser, for this purpose it is sufficient that an extension 16 of the cable be provided with adjusters known per se and routed to pass over the foot instep presser.

By providing a detent 18 on the front quarter, during the initial phase the locking of the foot instep presser is carried out and the closure of the quarters occurs successively.

It may be seen from the above description that the invention achieves its objects and in particular the fact should be emphasized that an extremely quick closure is provided in that it can be effected with a single lever.

Furthermore, the cable is caused to remain always or permanently fast with the quarter and therefore it is not necessary to hook back the cable after each opening to permit closure.

Another relevant aspect is that the adjustment is extremely simple in that it is effectuable by utilizing the sliding of the block 11 to which the camming lever is connected.

In practicing the invention, the materials used, so long as compatible with the specific use, and the dimensions and contingent shapes may be any ones meeting individual requirements.

We claim:

1. In a ski boot with a longitudinal extension a widthwise extension and an upwards extension and having a shell with a front quarter formation and a rear quarter formation hinged thereon to oscillate about an axis extending in said widthwise direction, a closure device for closing said rear quarter formation relative to said front quarter formation, comprising a lever articulated to the rear portion of said rear quarter formation about an axis extending in said widthwise direction to assume a first angular position when said closure device performs its closing function and a second angular position when said closure device leaves open said front quarter formation and said rear quarter formation relative to each other, said lever having guide means formations thereon, said lever having a first side facing towards said rear quarter formation when said lever is in said first angular position and a second side opposite to said first side and facing away from said rear quarter formation when said lever is in said first angular position thereof, said second side facing towards said rear quarter when said lever is in said second angular position thereof and said first side facing away from said rear quarter formation when said lever is in said second angular position thereof, a block member slidable on said lever at said first side thereof along said guide means formations thereof, said block member having locking means thereon for selectively locking at said first side of said lever said block member in a selected position along said guide means formations, control means for selectively controlling the locking action of said locking means, said control means being arranged at said second side of said lever, cable means associated with said block member and having at least one portion thereof secured to said front quarter formation, and further guide means in said rear quarter formation and in said front quarter formation for guiding therein said cable under operation, thereby to allow an adjustable closing and opening degree of said rear quarter formation with respect to said front quarter formation when said lever assumes said first and said second angular position depending on the locking position of said block member on said lever member.

2. A device according to claim 1, further comprising a length adjuster assembly in said cable means for adjusting the length of said cable means.

3. A device according to claim 1, wherein said ski boot includes a presser member within said front quarter formation and wherein said cable means have an extension cable routed into the inside of the shell to act onto said presser member.

4. A device according to claim 1, wherein said locking means are in the form of a serration on said block member and a mating serration on said lever and wherein said control means for controlling the locking action of said locking means comprise a camming lever on said second side of said lever for putting said serration and said mating serration in engagement with each other upon actuation of said camming lever in one direction and for disengaging said serration and said mating serration from each other upon actuation of said camming lever in an opposite direction.

5. In a ski boot with a longitudinal extension a widthwise extension and an upwards extension and having a shell with a front quarter formation and a rear quarter formation hinged thereon to oscillate about an axis extending in said widthwise direction, a closure device for closing said rear quarter formation relative to said front quarter formation, comprising a lever articulated to the rear portion of said rear quarter formation about an axis extending in said widthwise direction to assume a first angular position when said closure device performs its closing function and a second angular position when said closure device leaves open said front quarter formation and said rear quarter formation relative to each other, said lever having guide means formations thereon, said guide means formations defining a longitudinal slot in said lever, said lever having a mating serration thereon, a block member slidable on said lever along said guide means formations thereof, said block member having a tang formation extending therefrom, said tang formation being slidable within and along said longitudinal slot, said block memeber having a serration thereon facing said mating serration, locking means associated with said tang for selectively locking said block member in a selected position along said guide means formations by coupling said serration with said mating serration, cable means associated with said block member and having at least one portion thereof secured to said front quarter formation, and further guide means in said rear quarter formation and in said front quarter formation for guiding therein said cable under operation, thereby to allow an adjustable closing and opening degree of said rear quarter formation with respect to said front quarter formation when said lever assumes said first and said second angular position depending on the locking position of said block member on said lever member.

6. A closure device according to claim 5, wherein said locking means comprise a camming lever articulated on said tang and placeable in a first position, where it enables free sliding of said block on said lever, and a second position where it effects the coupling of said serration with said mating serration.

* * * * *